US006234083B1

(12) United States Patent
Tack, Jr.

(10) Patent No.: US 6,234,083 B1
(45) Date of Patent: May 22, 2001

(54) RESILIENT CLIP-ON WEAR PLATE

(75) Inventor: Carl E. Tack, Jr., Oak Park, IL (US)

(73) Assignee: Transdyne, Inc., Chicago, IL (US)

( * ) Notice: Subject to any disclaimer, the term of this patent is extended or adjusted under 35 U.S.C. 154(b) by 0 days.

(21) Appl. No.: 09/119,799

(22) Filed: Jul. 21, 1998

(51) Int. Cl.[7] ..... B61F 5/12
(52) U.S. Cl. ..... 105/225; 105/224.1; 105/222
(58) Field of Search ..... 105/220, 225, 105/218, 206.1

(56) References Cited

U.S. PATENT DOCUMENTS

| | | | | |
|---|---|---|---|---|
| 1,964,671 | | 6/1934 | Nesbitt . | |
| 2,648,573 | | 8/1953 | Wheildon . | |
| 3,381,629 | | 5/1968 | Jones . | |
| 3,638,582 | | 2/1972 | Beebe . | |
| 3,785,298 | | 1/1974 | Reynolds . | |
| 3,897,736 | | 8/1975 | Tack . | |
| 4,094,253 | | 6/1978 | Gage . | |
| 4,108,080 | | 8/1978 | Garner et al. . | |
| 4,168,666 | | 9/1979 | Gage . | |
| 4,170,180 | | 10/1979 | Houston . | |
| 4,203,371 | * | 5/1980 | Tack | 105/225 |
| 4,239,007 | | 12/1980 | Kleykamp et al. . | |
| 4,313,384 | | 2/1982 | Holden et al. . | |
| 4,363,278 | * | 12/1982 | Mulcahy | 105/218 R |
| 4,380,199 | | 4/1983 | Thomson et al. . | |
| 4,785,740 | * | 11/1988 | Grandy | 105/225 |
| 5,404,826 | * | 4/1995 | Rudibaugh et al. | 105/222 |

* cited by examiner

*Primary Examiner*—S. Joseph Morano
*Assistant Examiner*—Frantz Jules
(74) *Attorney, Agent, or Firm*—Pyle & Piontek

(57) ABSTRACT

A resilient clip on pedestal wear plate comprises a base with two opposing side lips for resiliently holding the base on a railway car side frame. When installed, the wear plate serves to prevent wear on the load bearing surface of the pedestal. The side lips of the wear plate comprise a center portion with spring arms extending therefrom to resiliently attach the plate to the side frame. Because the spring arms do not depend on bending of the base for their resiliency, the wear plate of the invention provides improved service stress capabilities.

14 Claims, 3 Drawing Sheets

RESILIENT CLIP-ON WEAR PLATE

BACKGROUND OF THE INVENTION

This invention relates to improvements in a wear plate specifically designed for convenient and removable installation in the pedestal opening of a railway side frame in order to prevent wear on the load bearing surface of the pedestal. Normally, a bearing adapter is provided over the axle bearing, said adapter having a slightly arcuate top surface which bears directly against a corresponding downwardly facing surface in the pedestal opening of the side frame. This arcuate top surface provides the wheel and axle with a freely pivoting end condition to avoid binding loads on the roller bearing.

In service, movement or frictional sliding may occur between the bearing adapter and the pedestal surface, which may cause worn spots on the frame, resulting in loss of the freely pivoting end condition and a weakening of the frame at a load bearing location. Repair of the frame surface is both expensive and time consuming, since the worn surface must be ground down to return it to a flat condition. The amount of grinding allowed is limited by structural considerations; after the limit has been reached the side frame casting is condemned.

To avoid this expensive and time consuming repair, replaceable wear plates may be used between the bearing adapter and the pedestal roof Previous U.S. Pat. Nos. 3,897,736 and 4,203,371, herein incorporated by reference, describe two embodiments of pedestal wear plates. Each of these embodiments constitutes a plate removably attached to the side frame in the pedestal opening comprising a wear surface against the bearing adapter. The plate has resilient side lips which resiliently clamp against the sides of the frame and tend to hold the plate in position during installation and service. Means are provided between the frame and the plate to limit longitudinal movement of the plate relative to the frame, in order to minimize wear on the frame.

As shown in previous U.S. Pat. Nos. 3,897,736 and 4,203,371, installation of the plate requires the plate be forced upwards onto the side frame such that the side lips forceably engage the sidewalls of the frame. So that the plates will be firmly held in place, the lips are separated from one another by a distance that is slightly less than the width of the side frame. This results in a slight elongation and bending of the plate when it is in its installed position, with resultant lateral bending stresses in the plate.

Previous U.S. Pat. No. 4,203,371 introduced a wear plate with a slightly arcuate base to accommodate the plate bending that occurs during installation. When the lips are separated by bending back away from each other and the plate installed, the slightly arcuate plate is flattened for service. Depending on the exact width of the side frame pedestal roof, the lips may need to be separated by slightly different distances from one installation to the next.

The stretching and bending of the plate surface required to install a plate results in lateral bending stresses in the plate surface ("installation bending stresses"). Side frame castings typically have a pedestal roof width tolerance of approximately 0.125". Given a particular side frame that may have a width towards the high end of tolerated widths, an installed wear plate will be stretched to a maximum, with resultant high lateral installation bending stresses. As the plate has a limited capacity to withstand total stress, high lateral installation bending stresses decrease the level of working load stresses that the plate may withstand. The working capacity of the plate therefore varies with the width of the pedestal roof, with particularly wide pedestal roofs resulting in high installation bending stresses and thus increased tendency for plate failure and shortened plate service life.

The plate working load and stress are defined as the frictional forces applied to the wear plate by the bearing adapter as a rail car in service shifts and moves about laterally. These frictional forces induce a tendency for lateral movement of the wear plate, and are opposed by the corresponding friction developed between the plate top and the pedestal roof surface. If this opposing frictional force is insufficient to resist this movement, additional bending load and stress are imposed on the upward side lips of the wear plate. The sensitivity to imbalance in these frictional forces, and hence the tendency to impose stress and load on the plate side lips, increases with heavily loaded rail cars such as coal cars.

The result of the total installation related tensile stresses in combination with stress related to bearing adapter friction can be a significant shortening of the plate service life. In some cases, the total tensile stresses developed may reach the yield strength of the of the plate and thereby cause bending of the plate. In other more severe cases the ultimate strength of the plate may be reached causing cracking.

This problem has been further complicated as of late because of recent frame painting practices. As environmental concerns have caused an effort to reduce volatile organic emissions from sources including paints, rail frames are increasingly being painted with solvent free and alternative solvent based paints. One of the disadvantages of these paints is that a resultant painted surface will have a significantly lower coefficient of friction as compared to a surface painted by older "traditional" paints; at times the new paint may even be thought of as acting as a sort of lubricant. This has the disadvantageous result of greatly reducing the frictional force between the plate top surface and the pedestal roof surface, thereby increasing the effective tensile stress in the plate. This has in turn resulted in an increased occurrence in wear plate bending and cracking.

Increasing the thickness of the plate would seem to offer a means to achieving increased plate strength sufficient to resist lateral movement and consequent failure. The benefits of increasing plate thickness, however, are limited. A practical limit on plate thickness exists as installation bending stresses caused as the side lips are forced apart during plate installation increase in direct proportion to the plate thickness. The difference between these installation bending stresses and the ultimate stress at which failure occurs determine the working capacity of the plate to resist movement. At some thickness a maximum plate working capacity is reached and further thickness increases actually decrease working capacity. Experience has shown a practical plate thickness limit to be approximately 0.109 inches.

For the above stated reasons, an unresolved need exists for a pedestal wear plate with an improved ability to withstand tensile stresses and thereby enjoy a reduced occurrence of bending and cracking.

OBJECTS OF THE INVENTION

It is an object of the invention to provide an improved resilient pedestal wear plate that will offer improved capacity to withstand tensile stresses, while not significantly increasing required installation effort.

SUMMARY OF THE INVENTION

The present invention comprises a clip on resilient pedestal wear plate. This wear plate solves the aforesaid problems associated with plate tensile stress bending and cracking, while not introducing any significant increase in required installation effort. This has been accomplished by substantially separating the stresses and deflection of the resilient "clip-on" feature, which holds the plate in place on the frame, from the structural base of the plate. Except for this "clip-on" feature, the wear plate is generally similar to those taught in previous U.S. Pat. Nos. 3,897,736 and 4,203,371, which are hereby incorporated by reference. They generally comprise a base with resilient opposing side lips.

The plate side lips comprise a center portion with two resilient spring arms extending therefrom. The resilient spring arms provide the "clip-on" feature of the plate, and are for frictionally engaging the rail car side frame to hold the wear plate in place. Because the action of the resilient spring arms required to frictionally engage the side frame does not require appreciable bending or stretching of the plate base, minimal installation related tensile stresses are developed.

As no appreciable bending or stretching of the base during installation occurs, substantially thicker bases may be used with the present invention than were possible with prior art embodiments, thereby allowing for significantly reduced failure and longer service life.

Further, the bending load imposed on the base as a consequence of movement is substantially reduced by the shortening of the moment arm over previous wear plate invention between the base and the point of application of the resisting load.

Accordingly, the objects of the invention have been well satisfied. These advantages and others will become more fully apparent from the following detailed description when read in conjunction with the accompanying drawings.

DETAILED DESCRIPTION

For the sake of brevity, the teachings of previous U.S. Pat. Nos. 3,897,736 and 4,203,371 are incorporated herein by reference, and the present invention represents an improvement over the wear plate shown in said patents.

Figure 1:
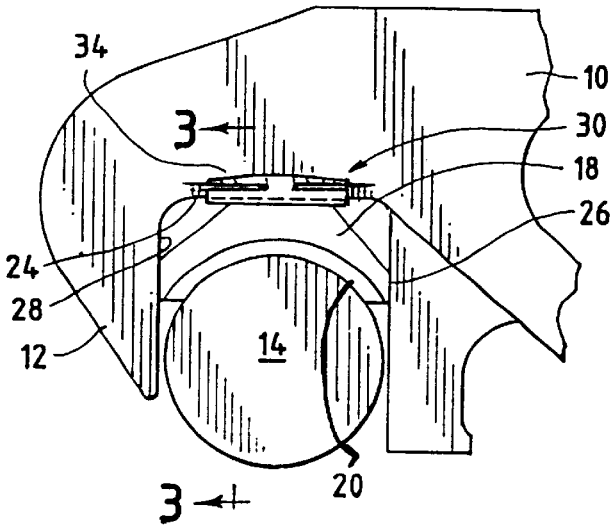
FIG. 1 is a fragmentary elevational view of one end of a railway truck side frame and axle, including the wear plate set of the present invention.

It will be understood to those skilled in the art that the drawings show only a fragmentary portion of a railway truck, which includes a pair of spaced side frames supported on wheel and axle assemblies, and a bolster connected between the side frames for supporting the car body. FIG. 1 illustrates one end of a side frame 10 terminating in the pedestal 12 in the form of a downwardly open pedestal jaw engaged over the axle 14 on which the car wheels are mounted.

Figure 2:
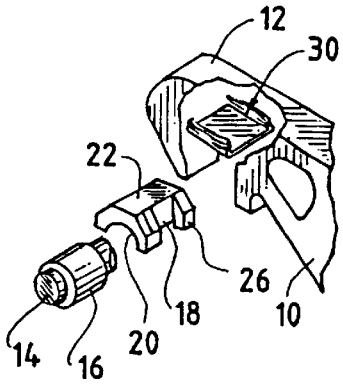
FIG. 2 is an expanded perspective view, with portions cut away, of the side frame and axle assembly of FIG. 1 further illustrating the component parts thereof in disassembly
Figure 3:
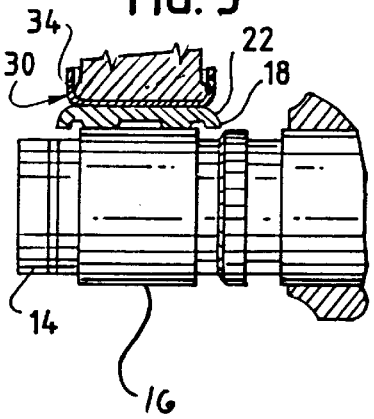
FIG. 3 is a transverse sectional view taken along section line 3—3 of FIG. 1

As shown in FIGS. 2 and 3, a roller bearing 16 is carried on the axle 14 near the end thereof, and a bearing adapter 18 is provided between the top portion of the bearing and the internal surfaces of the pedestal 12. The downwardly facing surface of the adapter 18 is curved at 20 to correspond to the cylindrical outer race of the bearing 16, and the upper portion of the adapter comprises a top slightly convex surface 22 which normally bears against a downwardly facing flat surface 24 in the pedestal opening. In addition, side surfaces 26 are provided on the adapter 18 in engagement with corresponding surfaces 28 in the pedestal opening. Thus the upper portion of the adapter is generally rectangular so as to be received in the rectangular pedestal opening or roof, although the adapter corners are omitted or cut away to prevent galling of the corners in the pedestal opening.

The foregoing parts are conventional and details thereof are readily available to the public. It will also be understood that the pedestal at the other end of the side frame is identical to the one described above.

As shown in FIGS. 1–4, the wear plate 30 of the present invention, as well as of U.S. Pat. Nos. 3,897,736 and 4,203,371, is generally in the form of a single, rectangular base plate, said plate having a pair of integrally formed lips 34 extending upwardly form opposite sides thereof, toward one another against the opposite side surfaces of downwardly facing surface 24. As shown, the lips 34 are co-extensive with the length of the base plate, which facilitates fabrication of the wear plate from a single rectangular metal or steel sheet, although any suitable lip configuration may be employed.

It will be noted that the foot portion of the lips of previous Pat. Nos. 3,897,736 and 4,203,371 comprise rectangular elements that bulge outwardly in an arc near their foot portion beyond the width of the base plate, with the upper edges inwardly spaced from the foot portion of the lips but are also flared out at their ends to facilitate installation.

Figure 4:
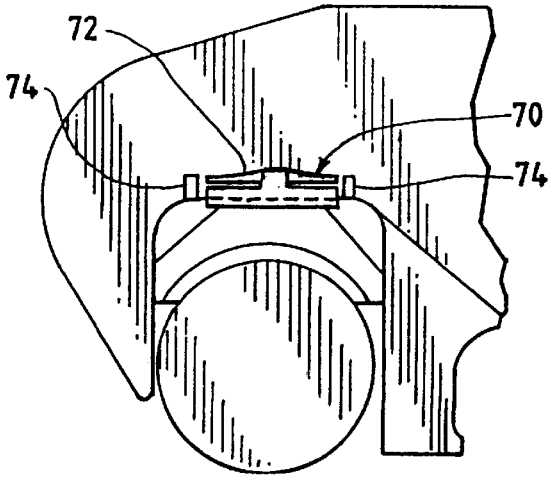
FIG. 4 is a view similar to FIG. 1 but further illustrating stops on the frame in engagement with the ends of the wear plate set.

FIG. 4 illustrates a means of imposing longitudinal restraint on a wear plate 70 having the lips 72 in engagement with the sides of the pedestal. In this embodiment, the sides of the side frame are provided with pairs of longitudinally spaced stops 74 which engage the opposite end surfaces of the lips and thereby prevent longitudinal movement of the plate.

In summary, the wear plate 30 is essentially resiliently capped over the surface to be protected on the side frame, which prevents accidental vertical dislodgment of the plate after installation. The plate is centrally mounted against the downwardly facing flat surface 24 of the pedestal opening, and the ends thereof are spaced from the corners of the opening, in order to prevent wear thereof by the plate. Since no welding or bolting of the plate is required, installation and removal of the plate may be effected very easily with simple tools.

In order to install the plate 30, the side frame 10 is lifted away from the axle 14, and the wear plate 30 is pushed onto the side frame, whereupon the truck may be reassembled.

The total tensile stresses acting upon the previous wear plate with rectangular lips as taught by my U.S. Pat. Nos. 3,897,736 and 4,203,371 include those that accompany the bending and stretching of the plate required for installation of the plate as the rectangular lips are forced apart, in addition to the stresses associated with the load. The sum total of these stresses may cause the wear plate to experience bending and cracking. These serious occurrences of plate bending and cracking have become more frequent in recent times as rail car frames are increasingly painted with newer alternative solvent or solvent-free paints. Because these paints result in a surface with a lower coefficient of friction than did surfaces painted with older paints, resultant tensile stresses in the wear plate have increased.

In order to alleviate this plate cracking and bending, a plate configuration that has a greater capacity to withstand tensile stresses is called for. The present invention accomplishes this requirement by allowing for a thicker plate to be used without any detrimental increase in installation related tensile stresses. Unlike the plate configuration as taught in previous patents, the present invention does not require appreciable bending or stretching of the plate surface to provide the spring action required of the lips to resiliently attach to the side frame. By utilizing a spring arm that does not appreciably rely on the bending of the base to resiliently clip the plate on the railcar side frame, plates of greater than present thickness may be used without introduction of any significant installation related tensile stresses. In general terms, the present invention separates the clip on resiliency action from the plate base.

Further, this invention also substantially reduces the distance between the base plate and the point at which the load resisting movement is applied. This distance is the moment arm which, along with the resisting force, determines the working bending stress on the plate base.

Figure 5:
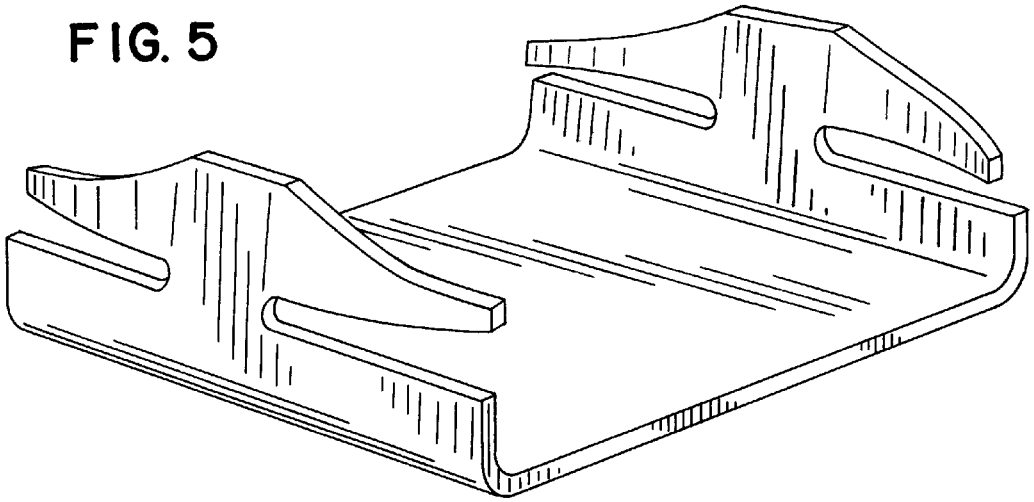
FIG. 5 is a three dimensional view of an embodiment of the present invention.

FIG. 5 provides a three dimensional view of a preferred embodiment of the invention. A generally rectangular base 101 has two opposing side lips 102 along its ends. Side lips 102 comprise a foot portion 103, a center portion 104 with two resilient spring arms 105 extending therefrom for frictionally engaging a railcar side frame and thereby holding base 101 in place. Although the preferred embodiment illustrated in FIG. 5 comprises a pair of spring arms on each lip, other embodiments may comprise different spring arm configurations that utilize one or several spring arms on each lip.

Figure 7:
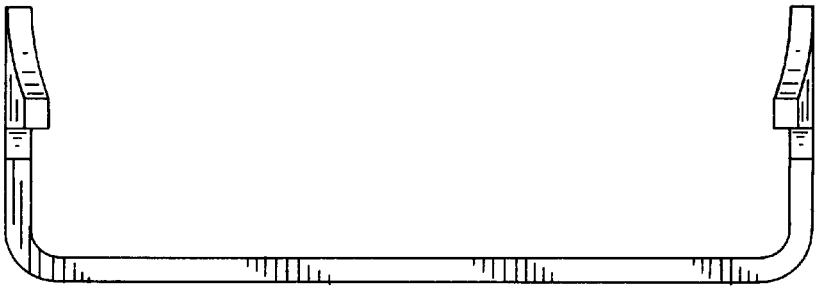
FIG. 7 is an end view of an embodiment of the present invention.
Figure 8:
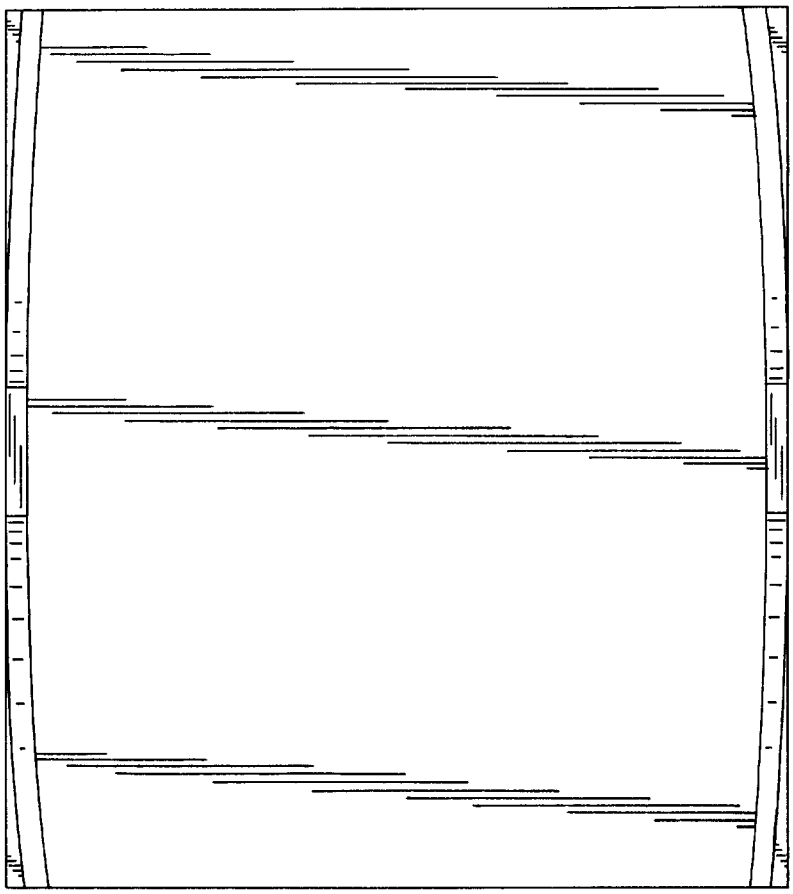
FIG. 8 is an above view of an embodiment of the present invention.
Figure 9:
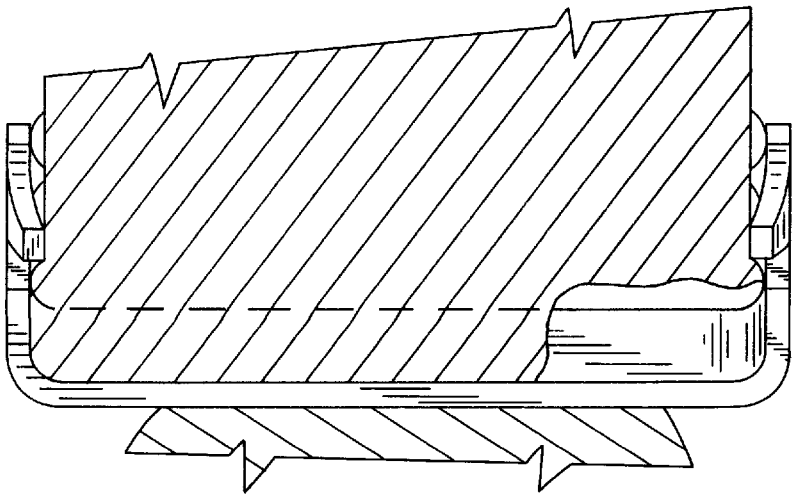
FIG. 9 is a three dimensional perspective view of the present invention installed on a side frame with a bearing adapter in contact with its lower plate surface, showing a portion of the side frame cut away.

As best illustrated in FIGS. 7 and 8, preferred spring arms 105 are arcuate with their inner surface concave, so that each respective arm end 106 is spaced apart from opposing spring arm end 106 by a distance D1 of substantially 5¾", while the respective side lip center portions 104 are spaced from the opposing center portion by a distance D2 of substantially 6¹⁄₁₆". These distances are useful for industry standard railcar side frames which have a standard width of 6", and may vary between 6¹⁄₁₆" and 5⅞" width. In this manner, as shown in FIG. 9, spring arm ends 106 will frictionally and resiliently engage railcar side frame 120, while side lip center portion 104 will not be frictionally engaged. Further, distance D2 is such that side lip center portion 104 will easily slide over bulge 121 near the base of the side frame 120.

Figure 6:
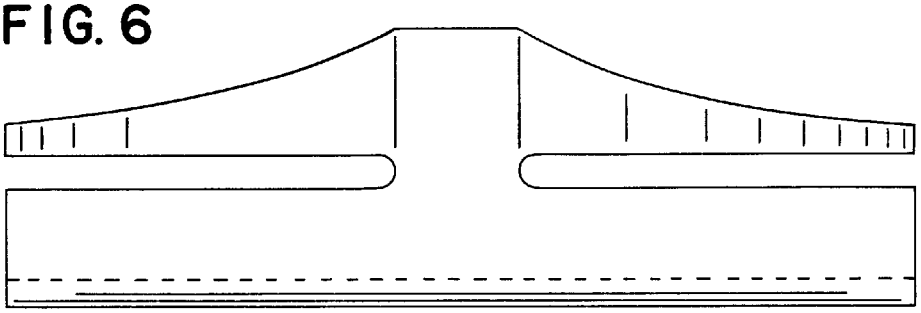
FIG. 6 is a side view of an embodiment of the present invention.

Because the spring action of the preferred embodiment of FIG. 6's spring arms 105 develops along their longitudinal direction, parallel to the longitudinal direction of the base 101, tensile stresses required to hold the plate in place are appreciably present only in the spring arms 105 and side lip center portion 104, and are not appreciably present in the base 101. In this manner the present invention accomplishes a separation of stresses relating to holding the plate in place from load related stresses. Thus no appreciable installation related stress develops in the base 101, thereby significantly increasing its capacity to withstand load related stresses over previous wear plates.

Also in FIG. 6, side lip 102 is comprised of center portion 104, two resilient spring arms 105 extending therefrom, and foot portion 103. Spring arm 105 is preferably separated from foot portion 103 by a slot which is defined by spring arm 105 lower edge 112, foot portion 103 upper edge 113, and center portion 104 edge 114. This preferred slot greatly reduces the potential for shear cracks to develop in center portion 104 due to spring arm 105 stresses. Also, it is preferred that center portion 104 edge 114 be arcuate so as to provide a uniform stress profile. Likewise, spring arm 105 preferred top edge 111 is arcuate and sloping downward from center portion 104. This preferred shape allows for a uniform stress profile to develop over spring arm 105.

FIG. 7 provides an end view of the preferred embodiment of the invention. This perspective illustrates that base 101 is preferably flat, providing for a more uniform and integral fit over side frame pedestal surface and for more uniform and integral contact with the bearing adapter than is typically achieved with prior plates that utilized an arcuate base. The plate is shown in service in FIG. 9 in place between a side frame pedestal surface and a bearing adapter 122.

It has been found that the preferred wear plate thickness is between ¹⁄₁₀" and ½", and that a preferred uniform thickness allows for most efficient fabrication. While it may be advantageous to utilize a wear plate with spring arms 105 of thinner material than is used for the base 101, the relatively high fabrication expense of such an article may make the article cost ineffective.

In view of the foregoing, it may be seen that with its spring arm configuration, the clip on wear plate does not develop appreciable tensile stress associated with its installation, and is thereby capable of withstanding substantially greater load related tensile stresses than previous wear plates. The spring arm design of the present invention accomplishes this by separating stresses related to holding the plate in place from load related stresses.

Further, as can be seen in FIG. 9, when the plate is in place about a railcar side frame, resistance to lateral movement will occur at the point on the side lip foot portion where the side frame bulge 121 is contacted, rather than higher up on the side lip. Because this point of resistance occurs closer to the base than did the point of contact and therefore resistance in prior art inventions, the moment arm of this resistance force is reduced. This further reduces the occurrence of plate failure.

The present invention thereby offers a practical and effective solution to the serious tensile stress related plate bending and breaking problems experienced by previous single wear plates.

While preferred embodiments and example configurations have been shown and described, it is to be understood that various further modifications and additional configurations will be apparent to those skilled in the art. Other embodiments of the invention, for example, may comprise more or fewer spring arms on each plate lip. It is intended that the specific embodiments and configurations disclosed are illustrative of the preferred and best modes for practicing the invention, and should not be interpreted as limitations on the scope of the invention as defined by the appended claims.

What is claimed is:

1. A clip on wear plate for installation on a downwardly facing flat surface in a pedestal opening of a side frame of a railway truck for engagement with a bearing adapter, the truck having lateral side walls, the pedestal opening having a downwardly facing surface; the clip on wear plate comprising:

a) a base having opposing lateral sides, said base having a pair of opposing side lips, with one each of said pair of opposing side lips on one each of said base opposing lateral sides; said lips rising upward from said base opposing lateral sides; said base having a bottom surface for engaging the bearing adapter and a top surface for engaging the pedestal downwardly facing surface; and b) each of said opposing side lips each having a center portion and at least one spring arm extending from said center portion for resiliently attaching said base to the side frame, each of said at least one spring arm inwardly arcuate towards said at least one spring arm extending from said opposing side lips; whereby when the wear plate is installed on the truck said opposing lips are proximate opposing of the truck lateral side walls above the pedestal opening and said at least one spring arm extending from each of said opposing lip center portions are in springing engagement with the truck lateral side walls above the downwardly facing flat surface thereby holding the wear plate in place.

2. A clip on wear plate as claimed in 1, wherein:

a) said at least one spring arm comprises a pair of spring arms, whereby said opposing side lips each have a pair of spring arms extending from said lip center portion; said pair of spring arms inwardly arcuate towards said pair of spring arms on opposing of said side lips;

b) said side opposing lips having a foot portion with a top edge;

c) said side lip center portion having opposing side edges, d) each of said pair of spring arms each having an arcuate upper edge and a lower edge, said arcuate upper edge sloping downward from said side lip center portion; and e) said side lip foot portion having a top edge, said side lip center portion having a side edge; said foot portion separated from said spring arm by a slot; said slot defined by said foot portion top edge, said spring arm bottom edge, and said center portion side edge, said center portion side edge defining an end of said slot being arcuate.

3. A clip on wear plate as claimed in 2, wherein said spring arms have ends, said opposing side lips center portions separated from one another by substantially 6 1/16", and said respective opposing spring arm ends separated by substantially 5 3/4".

4. A clip on wear plate as in claim 2, wherein when the plate is installed on the side frame:

a) said foot portion is in operative engagement with the truck lateral side wall above the pedestal opening to thereby resist lateral movement of said base relative to the side frame, and b) wherein said side lip center portion is spaced apart from the truck lateral side wall.

5. A clip on wear plate as claimed in 1, wherein said base and side lips having a thickness substantially between 1/10" and 1/2".

6. A clip on wear plate as claimed in 1, wherein said base and said side lip center portions have a thickness of substantially between 1/10" and 1/2", and said spring arms have a thickness of less than 1/4".

7. A clip on wear plate as claimed in 1, wherein means are provided to minimize movement between said wear plate and the side frame comprising a stop on the side frame in engagement with the wear plate.

8. The wear plate of claim 7, wherein a pair of stops are provided on said side frame, said stops engageable with corresponding ends of one of said lips.

9. A clip on wear plate as in claim 1, wherein at least a portion of said side lips are substantially co-extensive with said base.

10. A clip on wear plate as claimed in 1, wherein each of said pair of opposing side lips have a foot portion, said side lips center portion rising from said foot portion; said foot portion substantially co-extensive with said base; said foot portion rising substantially vertically upwards from said base for resilient engagement the lateral sidewall of the rail car above the pedestal opening when the wear plate is installed in the pedestal opening, said foot portion thereby resisting lateral movement of said base relative to the pedestal opening downwardly facing surface.

11. A clip on wear plate as in claim 1, wherein said base has a thickness greater than 0.2".

12. A clip on wear plate for installation on a downwardly facing flat surface in a pedestal opening of a side frame of a railway truck, the clip on wear plate comprising:

a) a base having a pair of opposing side lips, b) each of said side lips each having a center portion, said center portion having opposing side edges and having two spring arms extending therefrom for resiliently attaching said base to the side frame, each of said spring arms having a top edge and a lower edge, said top edge being arcuate and sloping downward from said lip center portion, c) said lip center portions separated from one another by substantially 6 1/16", said spring arms having ends, said spring arms inwardly arcuate such that opposing of said ends are separated by substantially 5 3/4", d) said spring arms having a foot portion, said foot portion having an upper edge, said spring arms having a lower edge, each of said spring arms separated from said foot portion by a slot defined by said foot portion upper edge, said spring arm lower edge, and said lip center portion side edge, said center portion side edge being arcuate; and e) said base having a thickness substantially between 1/10" and 1/2".

13. A clip on wear plate for installation on a downwardly facing flat surface in the pedestal opening of the side frame of a railway truck, comprising:

a) a base having a pair of opposing side lips; said lips having a foot portion with a top edge;

b) said lips each of said lips having a center portion and a pair of spring arms extending therefrom for resiliently attaching said base to the side frame, said center portion having opposing side edges, each of said spring arms each having an arcuate upper edge and a lower edge, said arcuate upper edge sloping downward from said center portion; and said foot portion separated from said spring arm by a slot defined by said foot portion top edge, said spring arm bottom edge, said center portion side edge, said center portion side edge defining said slot end being arcuate; and c) wherein said spring arms are substantially arcuate, have ends, said opposing lips center portions separated by substantially 6 1/16", and said respective opposing spring arm ends separated by substantially 5 3/4".

14. A clip on wear plate for installation on a downwardly facing flat surface in a pedestal opening of a side frame of a railway truck for engagement with a bearing adapter, the truck having lateral side walls; the clip on wear plate comprising:

a) a base having opposing lateral sides, said base having a bottom surface for engaging the bearing adapter and a top surface for engaging the pedestal downwardly facing surface; said base having a pair of opposing side lips with one each of said pair of opposing side lips rising upward from one each of said base opposing lateral sides;

b) each of said side lips each having a center portion and a pair of spring arms extending from said center portion for resiliently attaching said base to the side frame, each of said side lips each having a foot portion with a top edge; said side lip center portion having opposing side edges, each of said pair of spring arms inwardly arcuate towards said pair of spring arms extending from opposing of said lips; each of said pair of spring arms each having an arcuate upper edge and a lower edge, said arcuate upper edge sloping downward from said side lip center portion;

c) said side lip foot portion having a top edge, said side lip center portion having a side edge; said foot portion separated from said spring arm by a slot; said slot defined by said foot portion top edge, said spring arm bottom edge, and said center portion side edge, and d) whereby when the wear plate is installed on the truck said opposing lips are proximate opposing of the truck lateral side walls above the pedestal opening and said pair of spring arms extending from each of said opposing lip center portions are in springing engagement with the truck lateral side walls above the downwardly facing flat surface thereby holding the wear plate in place, wherein said foot portion is in operative engagement with the truck lateral side wall above the pedestal opening to thereby resist lateral movement of said base relative to the side frame, and wherein said side lip center portion is spaced apart from the truck lateral side wall.

* * * * *

UNITED STATES PATENT AND TRADEMARK OFFICE

CERTIFICATE OF CORRECTION

PATENT NO. : 6,234,083 B1
DATED : May 22, 2001
INVENTOR(S) : Carl E. Tack, Jr.

It is certified that error appears in the above-identified patent and that said Letters Patent is hereby corrected as shown below:

Column 7,
Line 16, delete "each" after "lips"
Line 31, delete "said opposing side lips each" and insert
-- each of said opposing side lips --
Line 38, delete "each" after "arms"

Column 8,
Line 29, delete "each" after 'lips"
Line 54, delete "said lips"
Line 58, delete first word "each"

Column 9,
Line 15, delete "each" after "lips"
Line 18, delete "each" after 'lips"

Signed and Sealed this

Eighteenth Day of December, 2001

*Attest:*

*Attesting Officer*

JAMES E. ROGAN
*Director of the United States Patent and Trademark Office*